US011495086B2

(12) United States Patent
Liu et al.

(10) Patent No.: US 11,495,086 B2
(45) Date of Patent: Nov. 8, 2022

(54) DETECTING CHEATING IN GAMES WITH MACHINE LEARNING

(71) Applicant: Microsoft Technology Licensing, LLC, Redmond, WA (US)

(72) Inventors: Yifeng Liu, Seattle, WA (US); Cierra D. McDonald, Seattle, WA (US); Timothy Arthur Gill, Kenmore, WA (US); Mark Allen Findlay, Issaquah, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 468 days.

(21) Appl. No.: 15/603,278

(22) Filed: May 23, 2017

(65) Prior Publication Data

US 2018/0182208 A1 Jun. 28, 2018

Related U.S. Application Data

(60) Provisional application No. 62/439,775, filed on Dec. 28, 2016.

(51) Int. Cl.
*G07F 17/32* (2006.01)

(52) U.S. Cl.
CPC ..... *G07F 17/3241* (2013.01); *G07F 17/3239* (2013.01)

(58) Field of Classification Search
CPC ..... G07F 17/3241; G07F 17/3239
USPC ..... 463/29
See application file for complete search history.

(56) References Cited

U.S. PATENT DOCUMENTS

| | | | | |
|---|---|---|---|---|
| 8,734,238 | B2 | 5/2014 | Arnone et al. | |
| 9,203,857 | B2 * | 12/2015 | Niccolini | H04L 63/1416 |
| 9,205,335 | B2 | 12/2015 | McDonald et al. | |
| 9,283,476 | B2 | 3/2016 | Mityagin et al. | |
| 2006/0074908 | A1 * | 4/2006 | Selvaraj | G06K 9/6269 |
| 2008/0182659 | A1 | 7/2008 | Sabella et al. | |

(Continued)

FOREIGN PATENT DOCUMENTS

EP 1642626 A1 4/2006

OTHER PUBLICATIONS

Alayed, et al., "Behavioral-Based Cheating Detection in Online First Person Shooters using Machine Learning Techniques", In Proceedings of IEEE Conference on Computational Inteligence and Games, Aug. 11, 2013, 8 pages.

(Continued)

*Primary Examiner* — Jay Trent Liddle
*Assistant Examiner* — Ryan Hsu
(74) *Attorney, Agent, or Firm* — Alleman Hall Creasman & Tuttle LLP

(57) ABSTRACT

Examples are disclosed that relate to detecting cheating at a game platform level using machine learning techniques. One example provides a computing system comprising a logic subsystem and a data-holding subsystem. The data-holding subsystem comprises instructions executable by the logic subsystem to receive notifications related to user progress in a game provided by the game to the online game platform, apply a classifying function to classify the user progress in the game as normal or outlying based upon the notifications, if the progress is classified as outlying then taking an action in response to the outlying classification, and if the progress is not classified as outlying then not taking the action.

4 Claims, 4 Drawing Sheets

(56) References Cited

U.S. PATENT DOCUMENTS

| | | | | |
|---|---|---|---|---|
| 2009/0113554 | A1 | 4/2009 | Zalewski | |
| 2009/0144415 | A1* | 6/2009 | Goglin | G06F 21/552 709/224 |
| 2013/0111019 | A1* | 5/2013 | Tjew | H04L 43/045 709/224 |
| 2013/0123003 | A1* | 5/2013 | Williams | A63F 13/10 463/29 |
| 2013/0227642 | A1* | 8/2013 | Chang | G06F 21/316 726/2 |
| 2013/0296039 | A1 | 11/2013 | Engineer et al. | |
| 2016/0307395 | A1* | 10/2016 | Frenkel | G07F 17/3209 |

OTHER PUBLICATIONS

Chapel, et al., "Probabilistic Approaches to Cheating Detection in Online Games", In Proceedings of IEEE Conference on Computational Inteligence and Games, Aug. 18, 2010, 7 pages.

Galli, et al., "A Cheating Detection Framework for Unreal Tournament III: a Machine Learning Approach", In Proceedings of IEEE Conference on Computational Inteligence and Games, Aug. 31, 2011, pp. 266-272.

Amer, et al., "Enhancing One-class Support Vector Machines for Unsupervised Anomaly Detection", In Proceedings of ACM SIGKDD Workshop on Outlier Detection and Description, Aug. 11, 2013, pp. 8-15.

* cited by examiner

DETECTING CHEATING IN GAMES WITH MACHINE LEARNING

CROSS REFERENCE TO RELATED APPLICATIONS

This application claims priority to U.S. Provisional Patent Application No. 62/439,775 filed Dec. 28, 2016, the entirety of which is hereby incorporated herein by reference.

BACKGROUND

Online gaming has become more and more popular as wide area network access across the world has become more available. Online game players may interact within both social and competitive environments. Over time, players may gain status among a gaming community by meeting defined goals, such as by earning achievements, in various games.

SUMMARY

Examples are disclosed that relate to detecting cheating at a game platform level using machine learning techniques. One example provides a computing system comprising a logic subsystem and a data-holding subsystem. The data-holding subsystem comprises instructions executable by the logic subsystem to receive notifications related to user progress in a game provided by the game to the online game platform, apply a classifying function to classify the user progress in the game as normal or outlying based upon the notifications, if the progress is classified as outlying then taking an action in response to the outlying classification, and if the progress is not classified as outlying then not taking the action.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

As mentioned above, players that utilize an online gaming platform may gain status among a gaming community by meeting defined goals in various games. For example, players that achieve defined goals in a game may be awarded items that can be used by the player in that game, in other games, and/or in other services offered by the platform, wherein such items may inform other players of that player's accomplishments on the platform. Likewise, the achievement of such goals, potentially in combination with other information (e.g. high scores in games played on the platform, amount of time spent playing games on the platform, etc.), may contribute toward a ranking of the player relative to other players on the platform. Such achievements and rankings may motivate players on the platform to continue to use the platform and improve game play over time.

However, some players may attempt to gain status by cheating, rather than by ordinary game play. For example, a player may hack a game in various ways to reduce the difficulty of the game, or to cause the game to award achievements when goals underlying the achievements may not have been met by the player.

To avoid such behaviors, game providers may implement mechanisms to enforce policies against cheating in a game. However, such mechanisms may only detect cheating occurring within the game itself. As such, a platform that hosts third party games may not be able to detect cheating that occurs in third party games, even where achievements in third party games are managed at the platform level. When the third-party game notifies the game platform of the improperly-awarded achievement, the game platform may award the player an item in response to the achievement, thereby rewarding the cheating behavior.

Thus, examples are disclosed that relate to detecting cheating in online games based upon interactions between the games and a game platform that hosts the games. As explained in more detail below, the disclosed examples use one or more classification functions trained by machine learning techniques to track interactions between a game and a game platform, such as notifications of achievements, game scores reported to the platform, and/or a player rank achieved on the platform based upon game activities. The classification functions may classify the interactions for a player as normal or outlying, and those interactions tagged as outlying may be further analyzed for possible cheating behaviors. In this manner, a potentially very large quantity of player data may be conveniently screened for possible cheating based upon patterns that are difficult to recognize via manual techniques.

Figure 1:
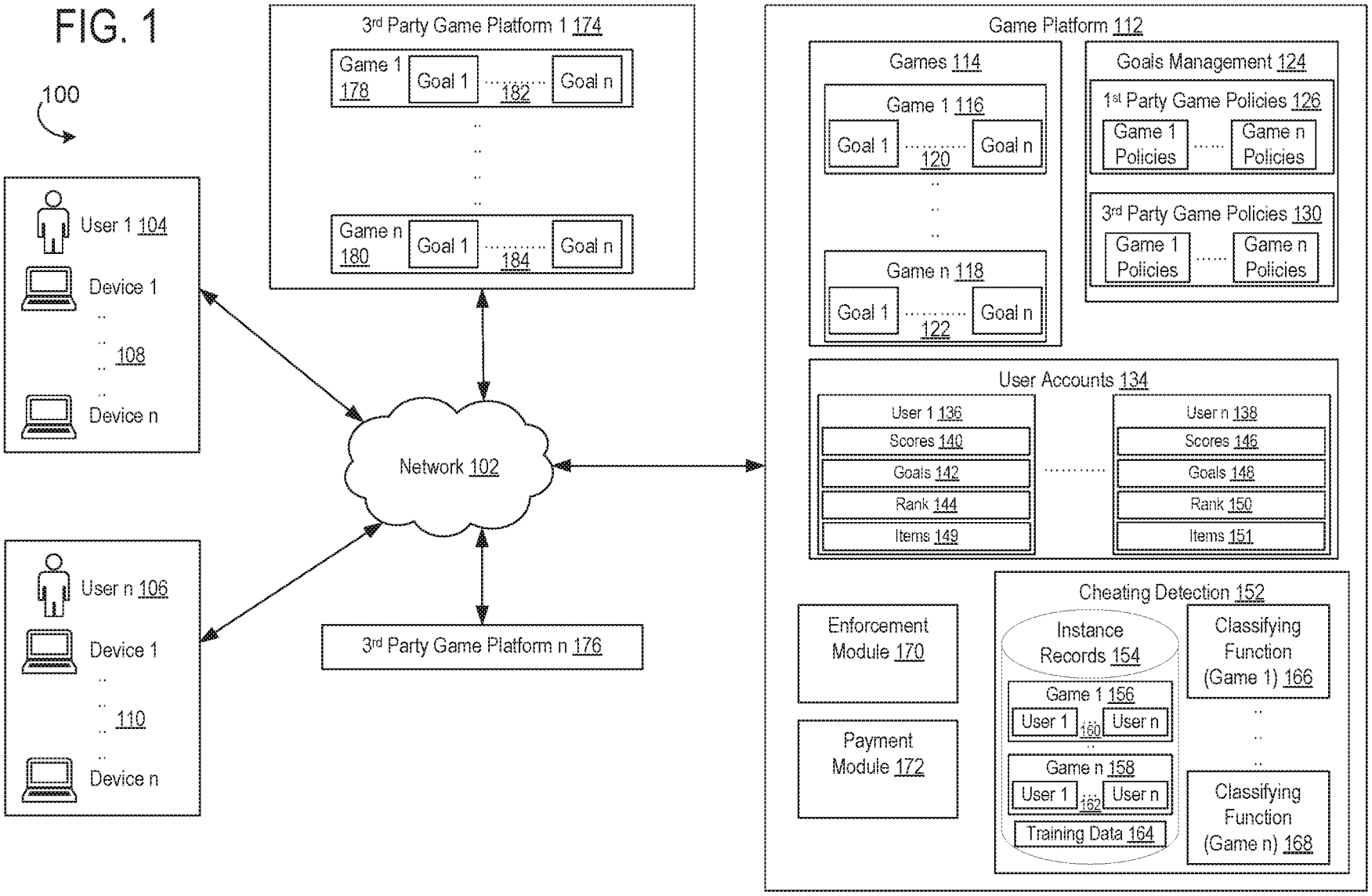
FIG. 1 shows a block diagram illustrating an example online gaming environment that comprises a platform-level cheating detection system.

FIG. 1 shows a block diagram illustrating an example online gaming environment 100 that comprises a platform-level cheating detection system. Players interact with the online gaming environment via a network 102. Example players are illustrated in FIG. 1 as user 1 104 and user n 106. FIG. 1 also shows one or more devices (e.g. game consoles, desktop computers, laptop computers, mobile devices, tablet devices, and/or wearable devices) 108 for gaming associated with user 1, and one or more devices 110 for gaming associated with user n.

FIG. 1 also shows an example game platform 112. Some games 114 may be hosted on game platform 112, illustrated schematically as games 116 and 118. Each game 116 and 118 comprises one or more goals 120 and 122 (represented as goal 1-goal n, wherein n is equal to or greater than one). The goals in a game may comprise, for example, specific challenges or tasks which a player can complete to obtain a reward in the game, such as virtual trophies, bonus points, avatar accessories, and/or any other suitable rewards. The term "item" may be used herein to represent any such award.

The game platform 112 further comprises a goals management module 124 configured to administer the awarding of items to players on the game platform 112 in response to notifications from games regarding players completing goals. The awarding of items based upon a goal completed in a game may be controlled based upon policies associated with the game that are managed by goals management module 124. Policies are shown as comprising first party game policies 126 and third party game policies 130, respectively representing awards supported on the platform for games offered directly by the entity that manages game platform 112 and also by third party game platforms 174, 176 that make their games accessible to users of the game platform 112, but that maintain control of the games separately from the game platform 112.

When a game notifies the goals management module 124 that a player has met a goal, the goals management module 124 may compare the information in the notification to the goals policies for that game, and award an item to the player if the information satisfies the relevant policy. Such awards are stored in user accounts database 134. Example user accounts are shown as user 1 account 136 and user n account 138. Any suitable information may be stored in each user account, including but not limited to scores information 140 and 146 (respectively for user 1 and user n), goals information 142 and 148, rank information 144 and 150, and items information 149 and 151.

Score information 140 and 146 may represent any suitable information regarding player scoring in one or more games. For example, the score information 140, 146 respectively for users 136, 138 may comprise a total score accumulated by each user 136, 138, a total score for a specific time window (e.g. a day or week), and/or high scores for individual games. Score information 140, 146 also may comprise scores awarded for activities on other resources available on the game platform 112 than playing games, such as points awarded for taking part in an online community. In another example, a player may make modifications to a game type or game map and then receive scores for contributing their modification to the game platform 112. As a further example, a player could also receive scores 140, 146 by defeating a number of other players while playing in an online, multiplayer game.

As mentioned above, when goals 120, 122 or third party game goals 182, 184, are met by a player, the game being played may send a notification to the goals management module 124. The goals management module 124 confirms that the player's information meets the relevant policy, and then updates the goals information 142, 148 in the user accounts database 134 to show that the goal has been met (and to award any items for meeting the goal). Goals information 142, 148 also may contain information regarding the meeting of goals in other platform activities, such as goals earned by taking part in the online community, and/or performing other interactions with the game platform 112.

Rank information 144, 150 may include ranking information for each player that quantifies a player's overall performance on the platform compared to that of other players. Such ranking information 144, 150 may be determined using any suitable information, such as the scoring information 140, 146 and/or the goal information 142, 148 for a player. Rank 144 or 150 may be tracked by game platform 112 for each user account of 134. Further, in some examples, additional scores may be given or goals may be completed for receiving a particular rank on the game platform 112.

Items 149, 151 may be awarded to a user for meeting a goal, such as meeting a threshold score or earning an achievement. Items may also be awarded for other acts or accomplishments. For example, items may be awarded to a player who participates in an online community for a game or moderates an online community. Items 149, 151 may be viewable by other players, and thus may give status to players that obtain the items To detect cheating occurring in games 120, 122, and also in third party games 178, 180, the game platform 112 includes a cheating detection module 152. The cheating detection module 152 is configured to detect possible instances of cheating based upon patterns of information that games provide to the platform regarding game play. The cheating detection module 152 comprises classifying functions, illustrated as game 1 classifying function 166 and game n classifying function 168, trained via machine learning techniques, that receive inputs of data provided by the games to the platform regarding progress of players in the games. Examples of such information include scores obtained, achievements met, items awarded, and ranks achieved. The classifying functions may utilize any suitable machine learning methods to perform such classification, including but not limited to, principal components analysis and support vector machines. The classifying functions may provide any suitable output. In some examples, the classifying functions may control a flag (e.g. a bit) that flags an account as outlying. In addition to flagging an instance record as outlying, the classifying functions also may output a confidence score associated with the determination.

Information on goals (e.g. achievements, scores, ranks) met by players is obtained by cheating detection module 152 and stored as instance records 154 for analysis by the classifying functions. Each instance record may represent goal data for a specific user in a specific game title, and may contain any suitable information. For example, an instance record for a game and a player may include information on achievements earned and how much total game play time it took the player to earn each achievement. An instance record also may include similar information with regard to scores earned in the game (e.g. a total number of points accumulated in the game and also how much time taken to achieve the total number of points).

The classifying functions are trained to identify instance records 154 that deviate sufficiently from those that represent normal game play as to be considered outlying. To be trained to perform this classification, the classification functions may utilize training data 164 that comprises instance records labeled as cheating or non-cheating. By training the classifying function using labeled data for the game, the function may be used to classify unlabeled instance records once trained. While the classifying functions are described above in the context of each function classifying a player's behaviors for a single game, it will be understood that a classifying function also may classify a player's behaviors in two or more games by using appropriate training data.

The classifying functions 166 and 168 may be triggered to run based upon any suitable trigger. For example, the classifying functions 166, 168 may be run on a pre-determined schedule (e.g. nightly), and/or based upon game-level or platform-level events (e.g. a user meeting a goal that results in the award of an item).

When an instance record is flagged outlying, a user account associated with the instance record may be further processed via an enforcement module 170. The enforcement module 170 may implement manual and/or automatic review and/or enforcement mechanisms. For example, the enforcement module 170 may comprise administrative accounts operated manually by administrators who review user accounts associated with flagged instance records 160, 162, and manually confirm or deny the status. In various examples, such manual review may be performed for all flagged user accounts, or only where an instance classification has a confidence level below a threshold. Likewise, in some examples, automatic enforcement may be performed on all flagged accounts, or on flagged accounts with a confidence score exceeding a threshold.

In some examples, the confidence level may be assigned based at least in part upon a history of a user account or device. The history may include information on interactions of the user account or device with on other games and with other platform functions (e.g. messaging, chat, etc.). Such cross-title awareness may give additional information on a behavior of a user that is relevant in determining possible cheating.

Any suitable enforcement actions may be taken, and different enforcement actions may be taken in different situations. Examples include temporarily suspending or banning a user account, amending a user's scores, goals, items or rank, or labeling the user account publicly to make other users of the gaming platform 112 aware that the user with the outlying instance has engaged in a form of cheating or unscrupulous on-line gaming behavior. Furthermore, the enforcement module 170 may interact with the payment module 172, such as by halting a payment, declining a pending transaction, or rolling back a prior transaction.

In some examples, feedback from the enforcement module 170 may be used to modify classifying functions 166 and 168 over time. For example, feature records that are tagged as outlying and later confirmed to be associated with cheating or not associated with cheating may be used as additional training data for the classifying functions. In this way, the predictive behaviors of the classifying functions may be refined over time.

Figure 2:
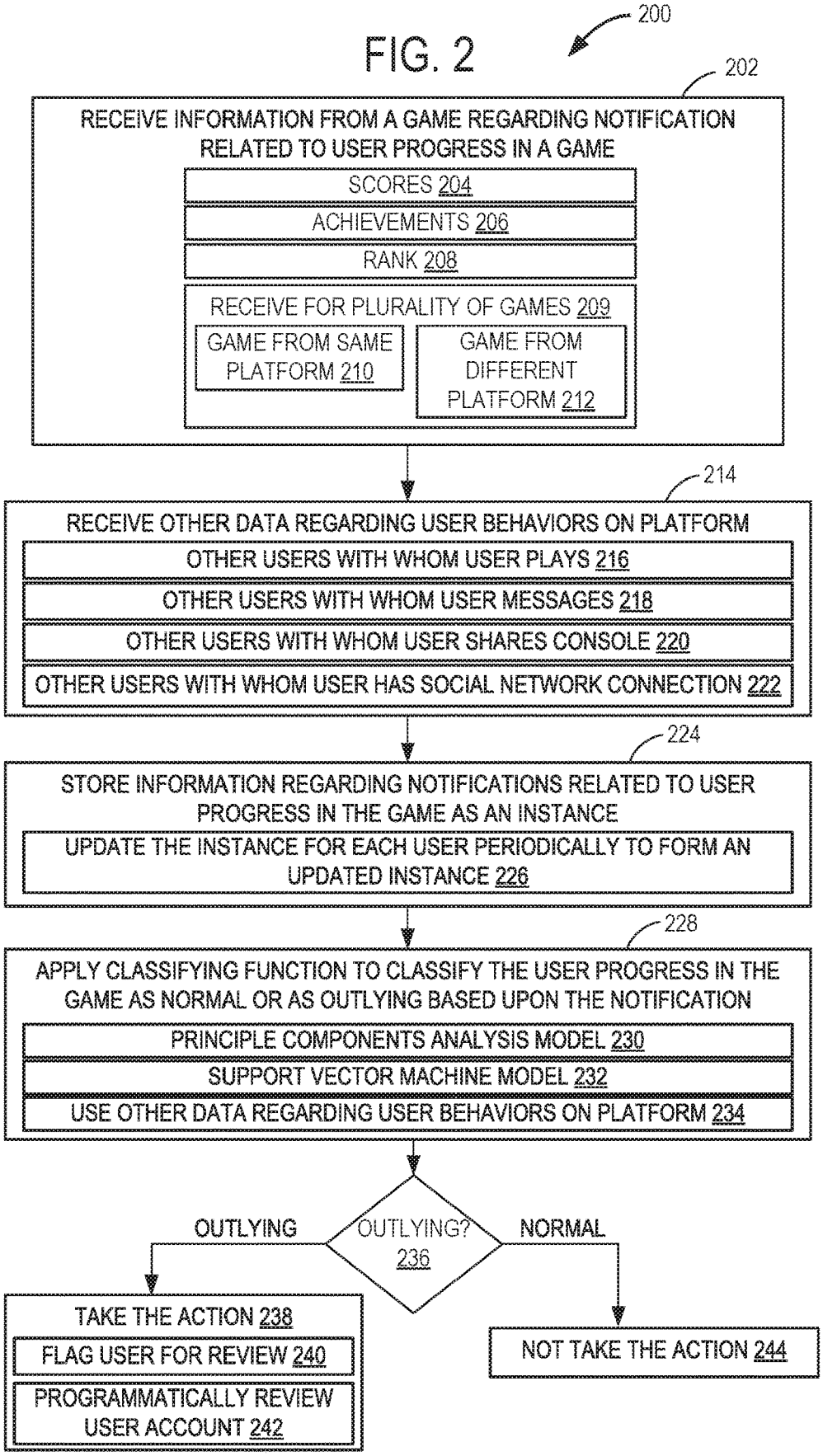
FIG. 2 shows a flow diagram illustrating an example method of detecting cheating in an online gaming system.

FIG. 2 shows a flow diagram illustrating an example method 200 of detecting at the platform level cheating behavior in an on-line gaming environment. Method 200 may be performed via any suitable computing system, such as those described with regard to FIGS. 1 and 4 herein. Method 200 comprises, at 202, receiving notifications regarding a user progress in a title or game. The notifications may include any suitable information. For example, a notification may include player identification, and progress information such as scoring information 204, (e.g. a high score, cumulative total score, a daily total score, etc.), achievement information 206, and rank information 208. Such information may be obtained for one or more games 209 on the game platform 210 and/or on a different game platform 212.

Continuing with FIG. 2, at step 214 the game platform may receive other data regarding user behaviors on the platform. Such data may include other users with whom the user plays 216, other users with whom the user messages 218, other users with whom user shares console 220, or other users with whom user has social network connections 222, as examples.

The information regarding notifications related to user progress in a game, and potentially other information about user behaviors, is stored as an instance record for the player and game, at 224. The instance record may updated on occasion (e.g. on scheduled times and/or as triggered by events) to form an updated instance 226.

Continuing, the cheating detection module 152 applies a classifying function, at 228, to classify an instance for a player and a game as normal or outlying, wherein the classifying function has previously been trained via machine learning. The classifying function may have been trained via any suitable machine learning technique. For example, the classifying function may represent a principal components analysis model 230 or a support vector machine model 232. Furthermore, any other data regarding user behaviors on the platform 234 may be used to classify an updated instance as normal or outlying.

Continuing with FIG. 2, as shown at step 236, if the user instance is classified as outlying via application of the classifying function, then an action is programmatically taken in response, at 238. For example, a user account associated with the instance may be flagged for review 240, or programmatically reviewed by computer via application of a review algorithm, as indicated at 242. The programmatic review of step 244 may be done, for example, by the enforcement module 170 described above in the description of FIG. 1. On the other hand, if the user instance is classified as normal, then the action is not taken, as indicated at 244.

Figure 3:
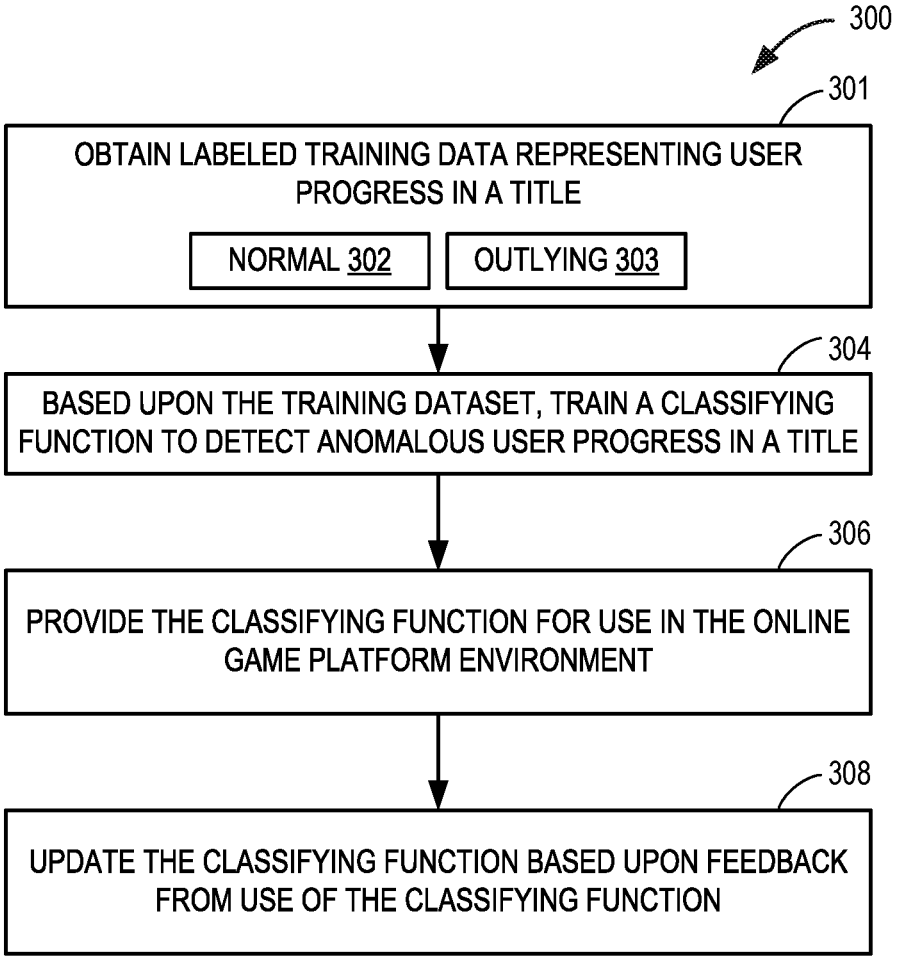
FIG. 3 shows a flow diagram illustrating an example method of training a classifying function for cheating detection via machine learning.

FIG. 3 shows a flow diagram illustrating an example method 300 of training a classifying function via machine learning. Method 300 comprises obtaining an initial training dataset comprising labeled data, at 301. The labeled training data may comprise a first subset of the data labeled normal 302 and a second subset of the data labeled outlying 303, wherein the normal data represents normal game progress data for a game as detectable at the platform level, and wherein the outlying data represents cheating behaviors as detectable at the platform level. In some examples, the training data comprises data for a single game, while in other examples, the training data comprises data for a plurality of games.

At 304, method 300 comprises using the training data to train a classifying function using machine learning techniques outlying. Non-limiting examples of classifying functions include principal components analysis and support vector machines.

After training the classifying function, method 300 comprises, at 306, providing the classifying function for use in an online game platform environment. In the online game platform environment, the classifying function may receive inputs of instance records, wherein each instance record comprises information provided by a game (or a plurality of games) to the online game platform regarding an identified player's progress in the game. The classifying function further provide outputs indicating whether or not the instance record is sufficiently anomalous to be considered outlying. In some examples, the output for an instance record may comprise a flag indicating the record to be an outlier. Further the output may comprise confidence information indicating a confidence level of the classification. In other examples, the classifying functions may provide any other suitable output(s).

As described above, information regarding whether a flagged instance record was determined in a later process to represent cheating or non-cheating behavior may be used to refine the classification function over time. As such, method 300 comprises, at 308, updating the classifying function based upon feedback from use of the classifying functions. Such feedback may include, but is not limited to, information regarding whether an instance record flagged as outlying actually represented cheating behavior or non-cheating behavior.

In some examples, the methods and processes described herein may be tied to a computing system of one or more computing devices. In particular, such methods and processes may be implemented as a computer-application program or service, an application-programming interface (API), a library, and/or other computer-program product.

Figure 4:
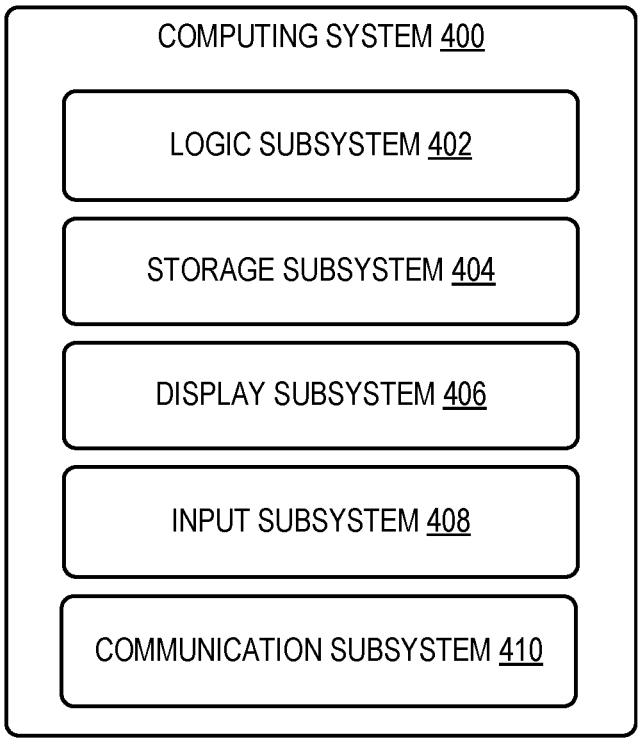
FIG. 4 shows a block diagram of an example computing device.

FIG. 4 schematically shows a non-limiting embodiment of a computing system 400 that can enact one or more of the methods and processes described above. Computing system 400 is shown in simplified form. Computing system 400 may take the form of one or more personal computers, server computers, tablet computers, home-entertainment computers, network computing devices, gaming devices, mobile computing devices, mobile communication devices (e.g., smart phone), and/or other computing devices. Computing system 400 may represent any of the devices within environment 100 of FIG. 1, for example.

Computing system 400 includes a logic subsystem 402 and a storage subsystem 404. Computing system 400 may optionally include a display subsystem 406, input subsystem 408, communication subsystem 410, and/or other components not shown in FIG. 4.

Logic subsystem 402 includes one or more physical devices configured to execute instructions. For example, the logic subsystem may be configured to execute instructions that are part of one or more applications, services, programs, routines, libraries, objects, components, data structures, or other logical constructs. Such instructions may be implemented to perform a task, implement a data type, transform the state of one or more components, achieve a technical effect, or otherwise arrive at a desired result.

The logic subsystem 402 may include one or more processors configured to execute software instructions. Additionally or alternatively, the logic subsystem may include one or more hardware or firmware logic subsystems configured to execute hardware or firmware instructions. Processors of the logic subsystem may be single-core or multi-core, and the instructions executed thereon may be configured for sequential, parallel, and/or distributed processing. Individual components of the logic subsystem optionally may be distributed among two or more separate devices, which may be remotely located and/or configured for coordinated processing. Aspects of the logic subsystem may be virtualized and executed by remotely accessible, networked computing devices configured in a cloud-computing configuration.

Storage subsystem 404 includes one or more physical devices configured to hold instructions executable by the logic subsystem to implement the methods and processes described herein. When such methods and processes are implemented, the state of storage subsystem may be transformed—e.g., to hold different data.

Storage subsystem 404 may include removable and/or built-in devices. Storage subsystem 404 may include optical memory (e.g., CD, DVD, HD-DVD, Blu-Ray Disc, etc.), semiconductor memory (e.g., RAM, EPROM, EEPROM, etc.), and/or magnetic memory (e.g., hard-disk drive, floppy-disk drive, tape drive, MRAM, etc.), among others. Storage subsystem 404 may include volatile, nonvolatile, dynamic, static, read/write, read-only, random-access, sequential-access, location-addressable, file-addressable, and/or content-addressable devices.

It will be appreciated that storage subsystem 404 includes one or more physical devices. However, aspects of the instructions described herein alternatively may be propagated by a communication medium (e.g., an electromagnetic signal, an optical signal, etc.) that is not held by a physical device for a finite duration.

Aspects of logic subsystem 402 and storage subsystem 404 may be integrated together into one or more hardware-logic components. Such hardware-logic components may include field-programmable gate arrays (FPGAs), program- and application-specific integrated circuits (PASIC/ASICs), program- and application-specific standard products (PSSP/ASSPs), system-on-a-chip (SOC), and complex programmable logic devices (CPLDs), for example.

The terms "module" and "program" may be used to describe an aspect of computing system 400 implemented to perform a particular function. In some cases, a module or program may be instantiated via logic subsystem 402 executing instructions held by storage subsystem 404. It will be understood that different modules and/or programs may be instantiated from the same application, service, code block, object, library, routine, API, function, etc. Likewise, the same module and/or program may be instantiated by different applications, services, code blocks, objects, routines, APIs, functions, etc. The terms "module" and "program" may encompass individual or groups of executable files, data files, libraries, drivers, scripts, database records, etc.

It will be appreciated that a "service", as used herein, is an application program executable across multiple user sessions. A service may be available to one or more system components, programs, and/or other services. In some implementations, a service may run on one or more server-computing devices.

When included, display subsystem 406 may be used to present a visual representation of data held by storage subsystem 404. This visual representation may take the form of a graphical user interface (GUI). As the herein described methods and processes change the data held by the storage subsystem, and thus transform the state of the storage subsystem, the state of display subsystem 406 may likewise be transformed to visually represent changes in the underlying data. Display subsystem 406 may include one or more display devices utilizing virtually any type of technology. Such display devices may be combined with logic subsystem 402 and/or storage subsystem 404 in a shared enclosure, or such display devices may be peripheral display devices.

When included, input subsystem 408 may comprise or interface with one or more user-input devices such as a keyboard, mouse, touch screen, or game controller. In some embodiments, the input subsystem may comprise or interface with selected natural user input (NUI) componentry. Such componentry may be integrated or peripheral, and the transduction and/or processing of input actions may be handled on- or off-board. Example NUI componentry may include a microphone for speech and/or voice recognition; an infrared, color, stereoscopic, and/or depth camera for machine vision and/or gesture recognition; a head tracker, eye tracker, accelerometer, and/or gyroscope for motion detection and/or intent recognition; as well as electric-field sensing componentry for assessing brain activity.

When included, communication subsystem 410 may be configured to communicatively couple computing system 400 with one or more other computing devices. Communication subsystem 410 may include wired and/or wireless communication devices compatible with one or more different communication protocols. As non-limiting examples, the communication subsystem may be configured for communication via a wireless telephone network, or a wired or wireless local- or wide-area network. In some embodiments, the communication subsystem may allow computing system 400 to send and/or receive messages to and/or from other devices via a network such as the Internet.

Another example provides a computing system comprising a logic subsystem including a logic device and a storage subsystem including a storage device, the storage subsystem comprising instructions executable by the logic subsystem to implement an online game platform and, for a game available in an online game platform, receive information from the game regarding notifications related to user progress in the game, the notifications provided by the game to the online game platform for each user of a plurality of users; for each user of the plurality of users, apply a classifying function to classify the user progress in the game as normal or as outlying based upon the notification provided by the game to the online game platform, the classifying function being trained via machine learning; based at least in part on the user progress in the game being classified as outlying, then take an action based upon classification as outlying; and based at least in part on the user progress in the game not being classified as outlying, then not take the action. In such an example, the instructions to receive the information regarding notifications may additionally or alternatively include instructions executable to receive information regarding one or more of achievements met in the game and points scored in the game. In such an example the instructions may additionally or alternatively be further executable to receive notifications based upon the user progress in a game executed on a different online game platform. In such an example, the instructions may additionally or alternatively be further executable to store the information regarding notifications related to user progress in the game as an instance for each user, and to update the instance for each user periodically to form an updated instance. In such an example, the instructions may additionally or alternatively be further executable to apply the classifying function to the updated instance for each user. In such an example, the instructions may additionally or alternatively be further executable to update the classifying function based upon feedback from applying the classifying function. In such an example, the instructions may additionally or alternatively be further executable to programmatically review an account of a user for whom user progress is classified as outlying. In such an example, the instructions may additionally or alternatively be further executable to receive data regarding other users with whom each user plays, and to use the data regarding other users with whom each user plays in determining whether to classify the user progress as outlying. In such an example, the instructions to apply the classifying function may additionally or alternatively include instructions executable to apply one or more of a principal components analysis model and a support vector machine model. In such an example, the instructions to receive notifications may additionally or alternatively include information regarding user progress in each game of a plurality of games on the online game platform.

Another example provides a computing system implementing an online game platform comprising a rewards system, a method comprising for each user of a plurality of users, receiving one or more notifications provided by the game to the game platform related to user progress in the game; for each user of the plurality of users, applying a classifying function to classify the user progress in the game as normal or as outlying based upon the notification provided by the game to the online game platform; based at least in part on the user progress in the game being classified as outlying, then taking an action based upon classification as outlying; and based at least in part on the user progress in the game not being classified as outlying, then not taking the action. In such an example, the instructions to receive one or more notifications may additionally or alternatively include receiving the one or more notifications based upon one or more of achievements met in the game and points scored in the game. In such an example, the instructions to take an action may additionally or alternatively include flagging a selected user for review based upon the user progress being classified as outlying. In such an example, the instructions to receive one or more notifications related to the user progress in the game may additionally or alternatively include receiving notifications provided by a game executed on a different online game platform related to the user progress in the game executed on the different online game platform. In such an example, the instructions to apply the classifying function may additionally or alternatively include applying one or more of a principal components analysis model and a support vector machine model. In such an example, the instructions may additionally or alternatively be further executable to include updating the classifying function based upon feedback obtained from applying the classifying function. In such an example, the instructions to receive one or more notifications related to the user progress may additionally or alternatively include receiving one or more notifications related to user progress in each game of a plurality of games on the online game platform.

Another example provides a computing system, comprising: a logic subsystem; and a data-holding subsystem comprising computer-readable instructions online game platform to for a selected game available in an online game platform, receive a training dataset comprising a plurality of labeled data each representing notifications provided by the game to the online game platform based upon user progress in the game, the labeled data comprising a subset of data labeled as anomalous; and based upon the training dataset, train a classifying function to detect anomalous user progress in the game. In such an example, the instructions may additionally or alternatively be further executable to apply the classifying function during game play after training the classifying function. In such an example, the instructions may additionally or alternatively be further executable to update the classifying function based upon additional data obtained by applying the classifying function during game play.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and non-obvious combinations and sub-combinations of the various processes, systems and configurations, and other features, functions, acts, and/or properties disclosed herein, as well as any and all equivalents thereof.

The invention claimed is:

1. A computing system, comprising:

a logic subsystem including a logic device; and a storage subsystem comprising a storage device, the storage subsystem comprising instructions executable by the logic subsystem to implement an online game platform hosting a plurality of games, each game of the plurality of games configured to send notifications to the game platform;

implement a cheating detection module configured to, for a game available on the online game platform, classify user instance records for the game as normal or outlying via a trained machine-learning classification function, each user instance record comprising information provided by the game to the online game platform regarding achievements earned by a user of the game, and for each achievement a total game time it took the user to earn the achievement, wherein user instance records classified as outlying represent possible cheating behavior;

for the game available on the online game platform, receive for each player of a plurality of players information from the game regarding notifications related to user progress in the game, the notifications provided by the game to the online game platform for each user of a plurality of users;

for each user of the plurality of users, store an instance record for the user, the instance record for the user comprising information regarding achievements earned by the user in the game and a total game play time it took the user to earn each achievement earned by the user in the game, input the instance record for the user into the trained machine- learning classifying function to classify the instance record for the user as normal or as outlying, based at least in part on the instance record for the user being classified as outlying, then take an action based upon classification as outlying, and based at least in part on the instance record for the user not being classified as outlying, then not take the action, wherein the instructions are further executable to update the instance record for each user periodically to form an updated instance record.

2. The computing system of claim 1, wherein the instructions are further executable to apply the trained machine-learning classifying function to the updated instance record for each user.

3. On a computing system implementing an online game platform hosting a plurality of games, each game of the plurality of games configured to send notifications to the online game platform, the online game platform comprising a rewards system and a cheating detection module configured to, for a game available on the online game platform, classify user instance records for the game as normal or outlying via a trained machine-learning classification function, each user instance record comprising information provided by the game to the online game platform regarding achievements earned by a user of the game, and for each achievement a total game time it took the user to earn the achievement, wherein user instance records classified as outlying represent possible cheating behavior, a method comprising:

for each user of a plurality of users, receiving information comprising one or more notifications provided by the game of the plurality of games to the online game platform related to user progress in the game;

for each user of the plurality of users, storing the information from the game in the instance record for the user, the instance record for the user comprising information regarding achievements earned by the user in the game and a total game play time it took the user to earn each achievement earned by the user in the game;

inputting the instance record into the trained machine-learning classifying function to classify the instance record as normal or as outlying;

based at least in part on the instance record in the game being classified as outlying, then taking an action based upon classification as outlying; and based at least in part on the instance record in the game not being classified as outlying, then not taking the action, wherein receiving information comprising one or more notifications comprises receiving information comprising one or more notifications based upon one or more of achievements met in the game and points scored in the game.

4. A computing system, comprising:

a logic subsystem; and a data-holding subsystem comprising computer-readable instructions to implement an online game platform hosting a plurality of games each configured to send notifications to the game platform, implement a cheating detection module configured to, for a game available on the online game platform, classify user instance records for the game as normal or outlying via a classification function trained by machine learning, each user instance record comprising information provided by the game to the online game platform regarding achievements earned by a user of the game, and for each achievement a total game time it took the user to earn the achievement, wherein user instance records classified as outlying represent possible cheating behavior, for a selected game available in the online game platform, receive a training dataset comprising a plurality of labeled instance records each representing notifications provided by the game to the online game platform associated with user progress in the game, the labeled instance records comprising a subset of instance records labeled as outlying, each labeled instance record comprising information regarding achievements earned by a user in the game and a total game play time it took the user to earn each achievement earned by the user in the game, and based upon the training dataset, train the classifying function of the cheating detection module to classify instance records as normal or outlying, wherein the instructions are further executable to apply the classifying function during game play after training the classifying function.

* * * * *